US005271344A

United States Patent [19]

Nishizawa et al.

[11] Patent Number: 5,271,344

[45] Date of Patent: Dec. 21, 1993

[54] METHOD AND APPARATUS FOR CONTROLLING AN AUTOMATIC SEWING MACHINE

[75] Inventors: Yoshifumi Nishizawa; Iwao Yamane, both of Aichi, Japan

[73] Assignee: Mitsubishi Denki K.K., Tokyo, Japan

[21] Appl. No.: 580,459

[22] Filed: Sep. 11, 1990

[30] Foreign Application Priority Data

Sep. 18, 1989 [JP] Japan ..... 1-240947

[51] Int. Cl.[5] ..... D05B 21/00

[52] U.S. Cl. ..... 112/121.12; 112/262.1

[58] Field of Search ..... 112/121.12, 121.11, 112/103, 457, 262.3, 266.1, 262.1; 364/400, 470

[56] References Cited

U.S. PATENT DOCUMENTS

| | | | |
|---|---|---|---|
| 4,674,420 | 6/1987 | Mizuno et al. | 112/121.12 X |
| 4,688,498 | 8/1987 | Carlson | 112/121.12 X |
| 4,691,649 | 9/1987 | Takano et al. . | |
| 4,704,977 | 11/1987 | Nukushina | 112/121.12 X |
| 4,727,818 | 3/1988 | Mizuno et al. | 112/121.12 X |
| 4,817,547 | 4/1989 | Gaeumann et al. . | |
| 4,825,784 | 5/1989 | Nomoto | 112/121.12 X |
| 4,899,287 | 2/1990 | Hulshoff et al. | 112/121.11 X |

FOREIGN PATENT DOCUMENTS

| | | |
|---|---|---|
| 58-51366 | 3/1983 | Japan . |
| 59-6097 | 1/1984 | Japan . |
| 62-84793 | 4/1987 | Japan . |
| 62-226356 | 10/1987 | Japan . |
| 63804 | 1/1988 | Japan . |
| 63-59712 | 11/1988 | Japan . |
| 1415328 | 11/1975 | United Kingdom . |
| 1504456 | 3/1978 | United Kingdom . |
| 1550238 | 8/1979 | United Kingdom . |
| 1561684 | 2/1980 | United Kingdom . |
| 1567513 | 5/1980 | United Kingdom . |
| 1571290 | 7/1980 | United Kingdom . |

*Primary Examiner*—Peter Nerbun

*Attorney, Agent, or Firm*—Sughrue, Mion, Zinn, Macpeak & Seas

[57] ABSTRACT

A control method and apparatus for controlling an automatic sewing machine having a plurality of memory units different in kind to record sewing patterns in which a particular one of these memory units is automatically selected, and an electric power supply for supplying power for an initial period of time upon occurrence of an electric power interruption is provided. The sewing operation may be externally controlled. The control method and the device for practicing the method can provide an automatic sewing machine which provides interchangeability of software and high reliability, and which can be readily operated on an automation line.

35 Claims, 13 Drawing Sheets

FIG. 7(a)1
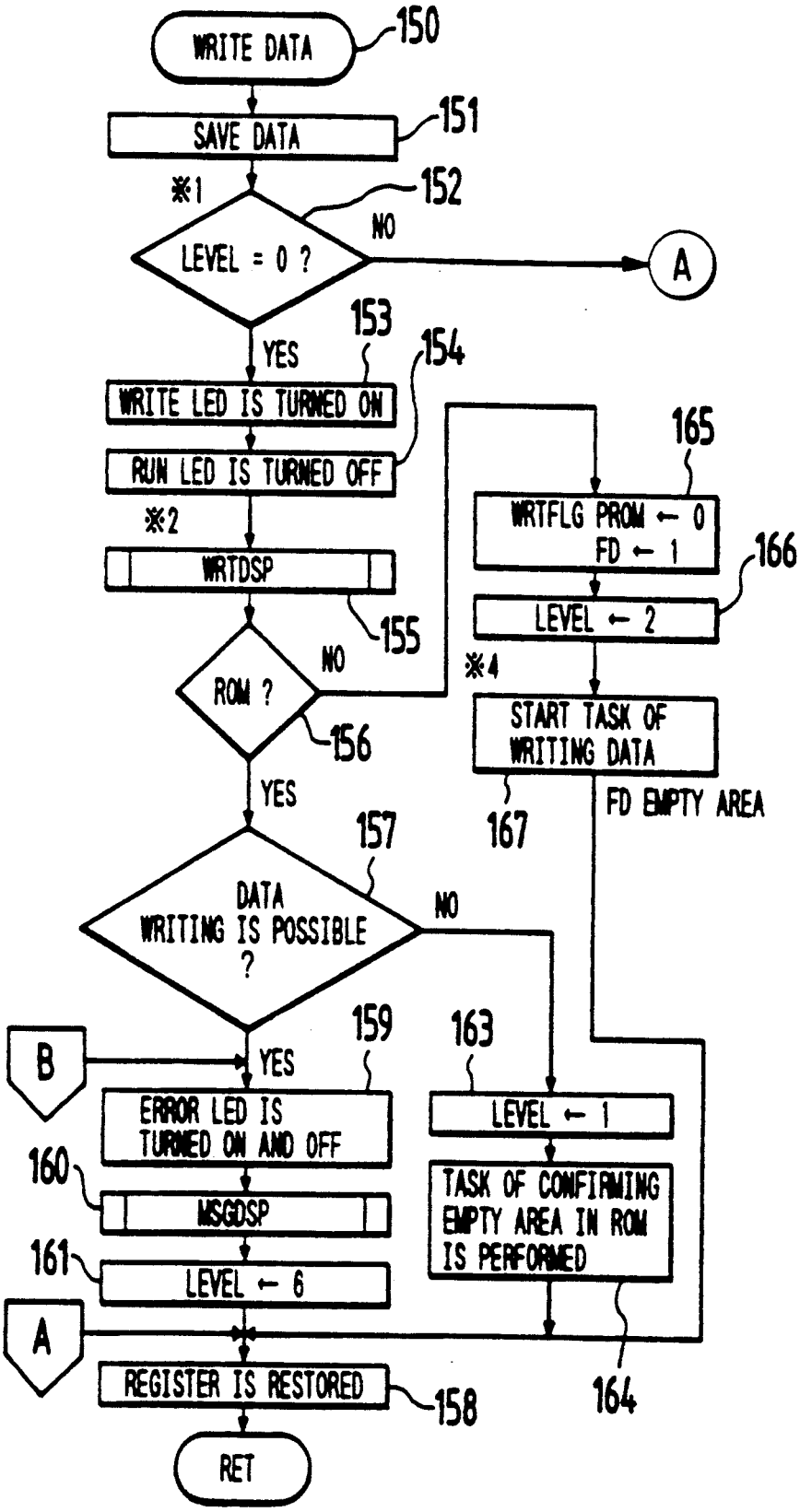

FIG. 7(a)2
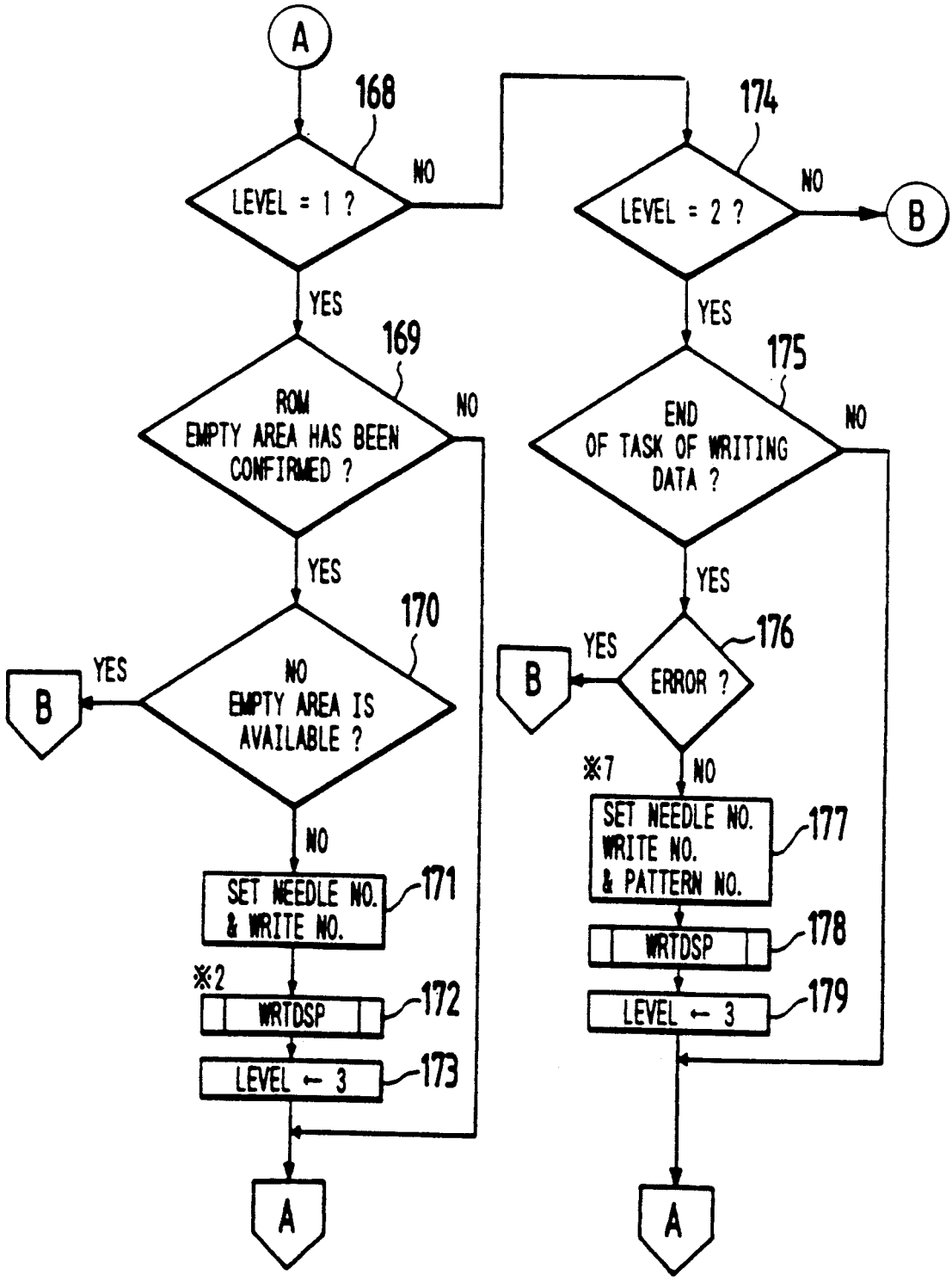

FIG. 7(a)3
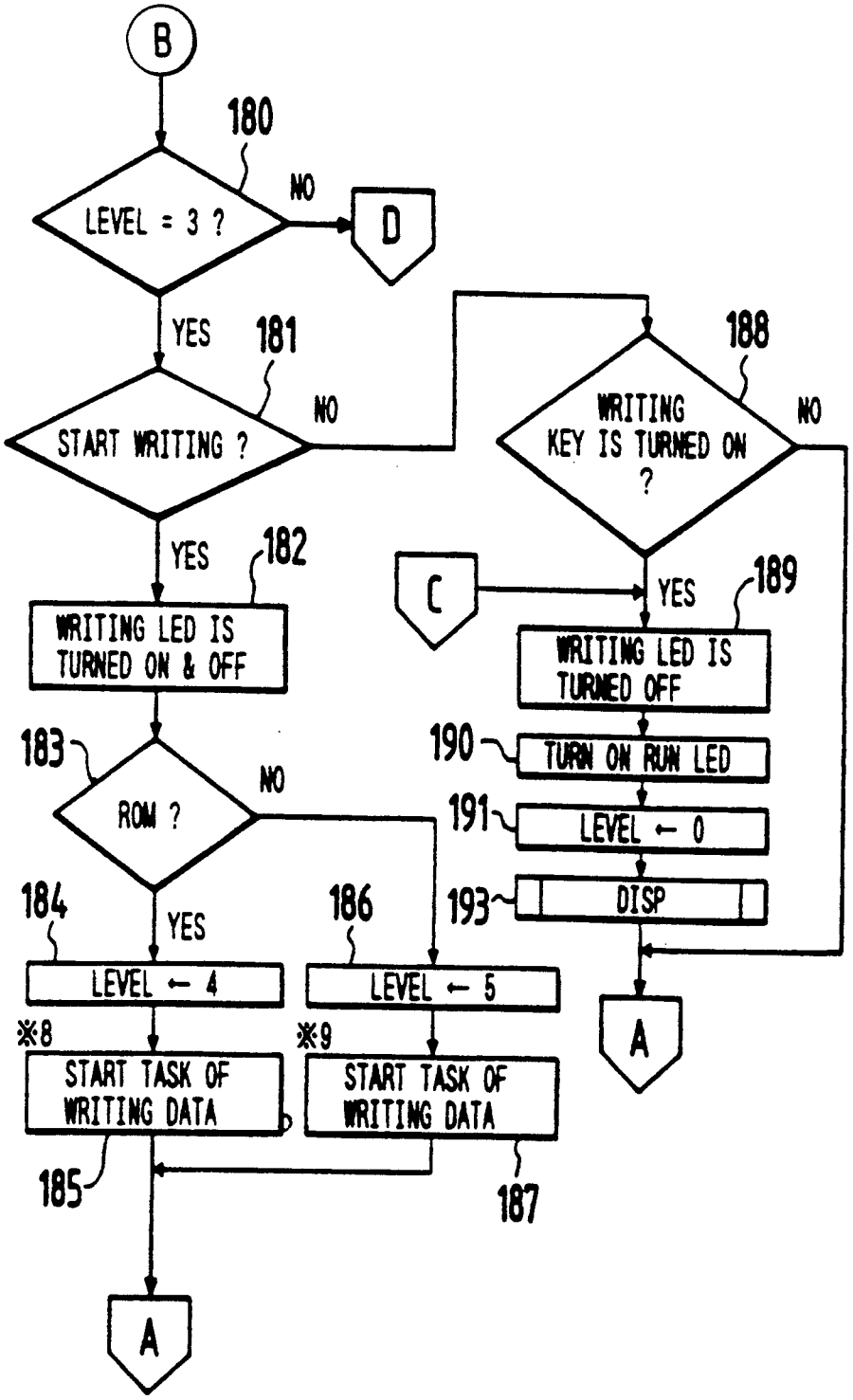

| | | |
|---|---|---|
| PA 0 | OS 10 | OUTSIDE RETAINING BOARD IS MOVED DOWNWARDLY |
| 1 | OS 11 | TWO-STEP RETAINING BOARD IS MOVED DOWNWARDLY |
| 2 | OS 12 | START |
| 3 | OHOME | RETURN TO ORIGIN |
| 4 | OSP 1 | SEWING SPEED |
| 5 | OSP 2 | |
| 6 | OSP 4 | |
| 7 | OSP 8 | |
| PB 0 | OPTN 1 | SEWING PATTERN NO. x 1 |
| 1 | OPTN 2 | |
| 2 | OPTN 4 | |
| 3 | OPTN 8 | |
| 4 | OPTN 10 | SEWING PATTERN NO. x 10 |
| 5 | OPTN 20 | |
| 6 | OPTN 40 | |
| 7 | OPTN 80 | |

METHOD AND APPARATUS FOR CONTROLLING AN AUTOMATIC SEWING MACHINE

BACKGROUND OF THE INVENTION

This invention relates to a method of controlling an automatic sewing machine in which a cloth retainer holding a workpiece such as a piece of cloth is moved along a predetermined configuration with the aid of memory elements, thereby to provide a seam along the predetermined configuration, and a device for practicing the method.

FIG. 1 shows an external appearance of a conventional ordinary automatic sewing machine. The automatic sewing machine comprises: a sewing mechanism section 25 on a sewing table 201 which incorporates a mechanism for forming a seam on a material to be sewed (herein after referred to as "a sewing material", when applicable) with a needle bar 202; an electric motor 203 for driving the sewing mechanism section; a cloth retaining unit 206 for holding a sewing material between an upper retaining board 204 and a lower retaining board 205 with the aid of air; and a biaxial drive mechanism 208 for two-dimensionally moving the cloth retaining unit 206 on a slide board 207 according to a predetermined pattern. A control unit 209 for controlling the operations of the above-described components is provided in the form of two parts, upper and lower parts, on one side of the sewing table 201. The upper part of the control unit 209 comprises: an operating panel 210 on which a variety of switches for controlling the operations of the automatic sewing machine are provided; and a data reading device for reading data from a memory medium 6 inserted thereinto in which data on the patterns of movement of the biaxial drive mechanism have been stored. That is, the upper part of the control unit operates to control the operation timing of the entire sewing machine, and the movement of the biaxial drive mechanism 208.

More specifically, the operating panel 210 has power switches 211, a reset switch 212 positioning the biaxial drive mechanism 208 in place and resetting the system, and a test switch 213 for performing a biaxial drive with the needle bar maintained stopped.

A start switch 217 for providing a sewing start instruction, and a switch 214 for holding the cloth retaining unit 206 (hereinafter referred to as "a cloth retaining switch 214", when applicable) are provided below the sewing machine body. The aforementioned sewing mechanism section 25 has a stop switch 215 for stopping a sewing operation. The biaxial drive mechanism 208 has original point detecting units 29 and 30 for detecting the mechanical original point of two axes.

FIG. 2 is a block diagram showing the arrangement of the conventional control unit 209.

In FIG. 2, reference numeral 1 designates a central arithmetic unit (hereinafter referred to as "a CPU 1", when applicable); 32, a crystal oscillator for forming a clock signal for the CPU 1; 2, an integrated circuit for latching an address provided by the CPU 1 (hereinafter referred to as "an address latching circuit 2", when applicable, which is 74LS373 for instance); 3, an integrated circuit for buffer for transmitting data between the CPU 1 and memory (hereinafter referred to as "a memory data buffer 3", when applicable, which is 74LS245 for instance); 4, an integrated circuit for buffer for transmitting data between an input/output interface element 8 (hereinafter referred to as "an I/O 8", when applicable) and the CPU 1 (hereinafter referred to as "a peripheral data buffer 4", when applicable, which is 74LS245 for instance); 5, an IC select signal generating circuit for producing IC select signals for selecting memories and peripheral elements; 6, a RAM used for a stack in the execution of a program for instance; **7-*a*, a ROM storing programs; 7-*b*, a nonvolatile memory unit in which sewing patterns are stored (hereinafter referred to as "a pattern ROM 7-*b*", when applicable); 8, the aforementioned I/O serving as an interface in response to instructions from the CPU; 15, a group of switches; and 9, a circuit which receives data through the I/O 8 to control the motor 203** for rotating the spindle of the sewing machine.

Further in FIG. 2, reference numeral 10 designates an input interface circuit for shaping the output signal waveform of the detector 26 which detects the speed of rotation of the spindle of the sewing machine and the position of the needle bar 202; 12, an input interface circuit for shaping the output signal waveform of a foot switch assembly 31; 13, a drive circuit for driving pulse motors 27 and 28 to operate the biaxial drive mechanism 208; 14, a drive circuit for driving a solenoid or electromagnetic valve 23 to operate the cloth retaining unit and a thread cutting unit; and 16, an electric power circuit for supplying electric power to all of the circuits in the sewing machine.

The operation of the automatic sewing machine thus constructed will be described.

First, the power switch 211 of the control unit 209 is turned on to start the motor 203. At the same time, electric power is supplied to the electric power circuit 16 in the circuit (FIG. 14) of the control unit 209, to start the control circuit. First, the CPU 1 reads from the ROM **7-*a* a program for initially setting itself and the I/O 8, and initially sets them. Thereafter, the reset switch 212 in the group of switches is closed, so that the CPU 1 receives the information through the I/O 8, and operates the pulse motors 27 and 28 through the I/O 8 to operate the biaxial drive unit 208. Thereafter, the biaxial drive unit 208 is driven until the original point detecting units 29 and 30 provide original point signals, so that the biaxial drive unit is moved to a predetermined position (hereinafter referred to as "a mechanical original point", when applicable). Under this condition, the operator or sewing person sets the sewing material between the upper and lower retaining boards 204 and 205, so that the sewing material is positioned in place. When the cloth retaining switch 214 in the foot switch assembly 31 is closed, the CPU 1 receives the signal through I/O 8, and operates the electromagnetic valve 23 through the I/O 8 to activate a pressure plate 216, so that the upper retaining board 204 is moved downwardly; that is, the sewing material is held between the upper and lower retaining boards 204 and 205. Thereafter, when the start switch 217 in the foot switch assembly 31 is closed, a signal is applied through the I/O 8 to the CPU 1, so that the CPU 1 reads one of ten pattern data which are programmed in the ROM 7-*b* in advance and limited by the group of switches 15. According to the data thus read, the CPU 1 drives the biaxial drive unit 208 through the I/O 8, and operates the motor 203 through the I/O 8 to drive the sewing mechanical section 25**, as a result of which a seam is formed on the sewing material in accordance with the predetermined pattern.

After the sewing operation, the CPU 1 applies a drive signal through the I/O 8 to the thread cutting solenoid 23, to cut the thread. Thereafter, the motor 24 is stopped, and the sewing mechanical section 25 is stopped. The cloth retaining unit electromagnetic valve 23 is turned off, and the cloth retaining unit 206 releases the sewing material.

The conventional automatic sewing machine control device is designed as described above. Therefore, the capacity of the ROM **7-*b*** is insufficient, being 128 k bytes in maximum. In addition, it is rather troublesome to handle the ROM, because it may be broken when held directly with the hand. In order to eliminate the difficulties, Japanese Patent Application (OPI) No's 6097/1984, 226356/1987 and 51366/1983 (the term "OPI" as used herein means an "unexamined published application") have proposed a method in which magnetic memory means are used to store sewing pattern data (hereinafter referred to as "FDs", when applicable). However, employment of the FDs is not welcome by the users using an automatic sewing machine control device with a ROM in which sewing pattern data are stored, because the FD is not interchangeable with the ROM.

Furthermore, the employment of the FDs suffers from the following difficulties. The control device using the FD is liable to be adversely affected by variation of environmental conditions, or it is liable to erroneously operate when the power supply is interrupted momentarily. With a system using a floppy disk, the floppy disk must be rotated when the power source is turned on, as a result of which the system is relatively short in service life.

Furthermore, in the conventional automatic sewing machine control device, the group of switches 15 are used to select sewing patterns and to set sewing speeds, and the foot switch assembly 31 is operated to retain a sewing material and to start the sewing machine. Therefore, it is necessary to provide one operator for one or two automatic sewing machines, and it is rather difficult to realize the unmanned operation of the automatic sewing machines.

SUMMARY OF THE INVENTION

An object of this invention is to eliminate the above-described difficulties accompanying a conventional automatic sewing machine control device. More specifically, an object of the invention is to provide an automatic sewing machine control method, and a control device for practicing the method in which different kinds of memory units can be interchangeably used and, of the memory unit, a desired one is automatically selected, and even in the case where memory units different in their read/write system are employed, they can be stably accessed for reading and writing operations, and the automatic sewing machine can be externally controlled, thus permitting the unmanned operation of the automatic sewing machine.

In a control device provided for an automatic sewing machine according to the invention, a plurality of memory units different in kind adapted to store sewing patterns are employed, and of these memory units, a particular one is selected.

The control unit is provided with means for supplying electric power for the initial period of time upon occurrence of an electric power interruption.

The control unit includes communication means through which the sewing operation is externally controlled.

The automatic sewing machine according to the invention can be operated on memory units different in operating system, and its sewing operation can be externally controlled.

DESCRIPTION OF THE PREFERRED EMBODIMENTS

An embodiment of this invention will be described with reference to FIG. 3.

Figure 3:
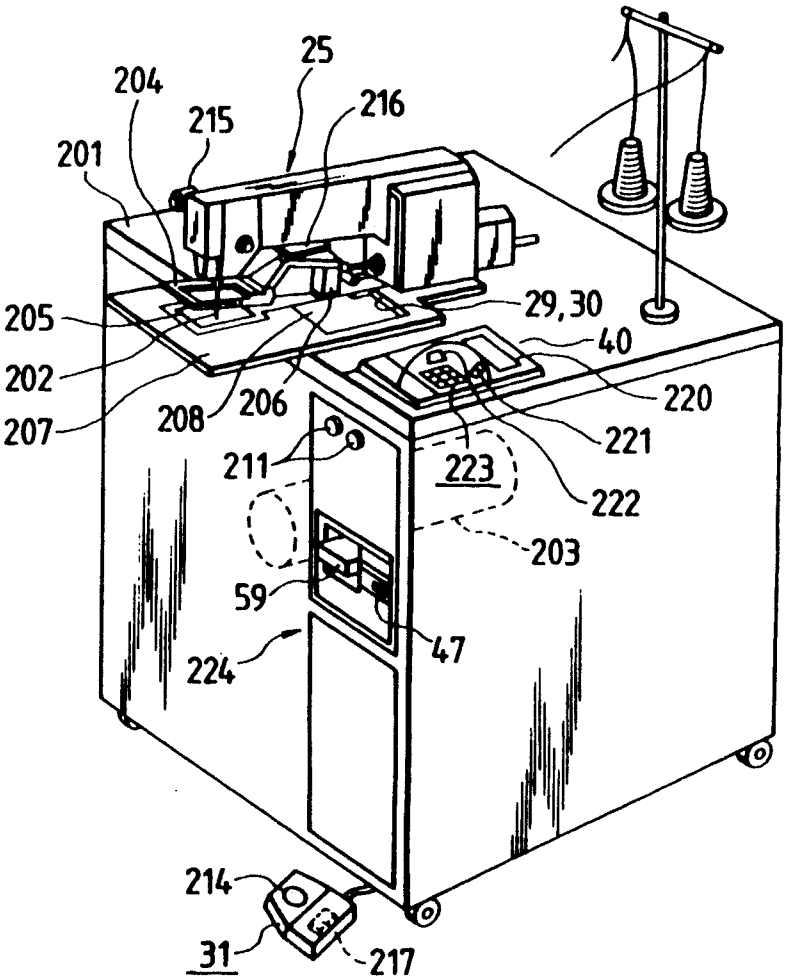
FIG. 3 is an external view showing an embodiment of the present invention.
Figure 1:
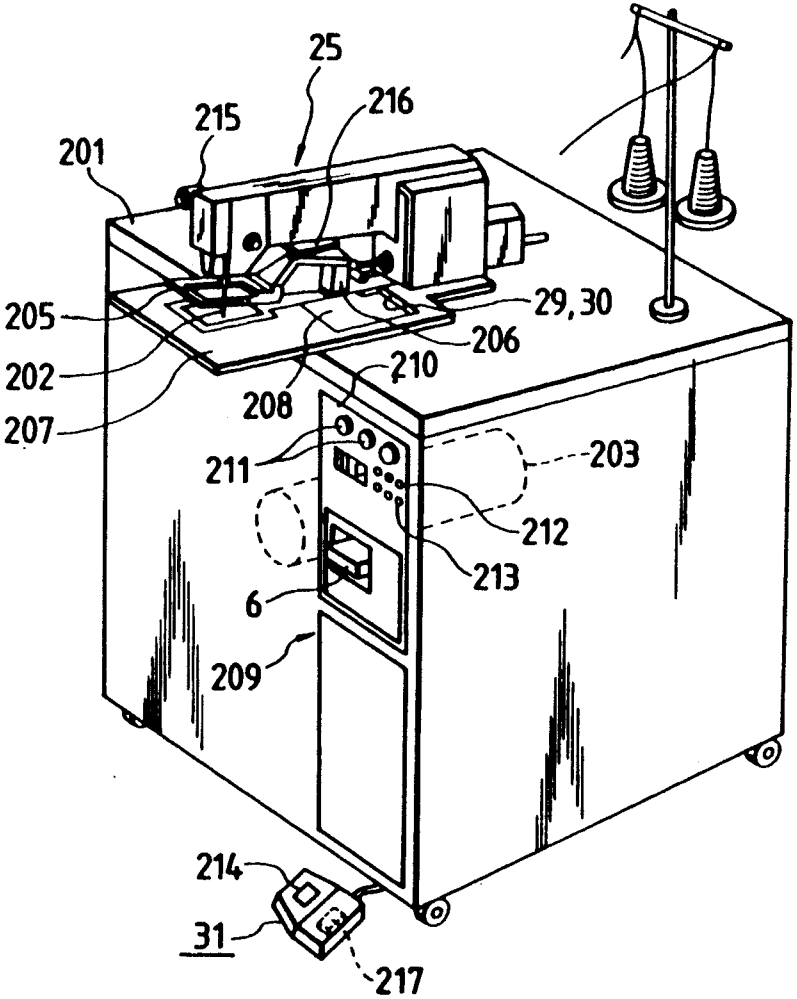
FIG. 1 is a schematic diagram showing an external view of a conventional ordinary automatic sewing machine.
Figure 2:
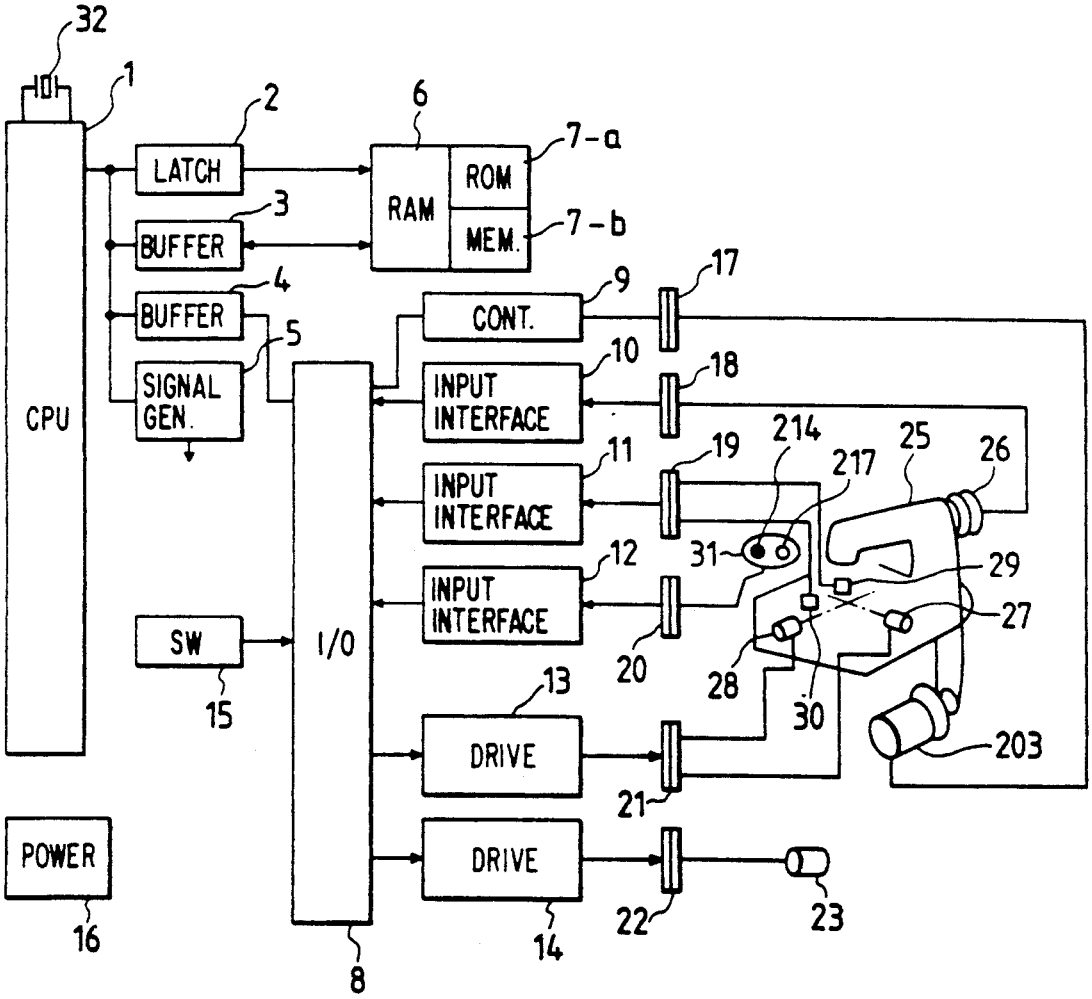
FIG. 2 is an explanatory diagram, partly as a block diagram, showing the arrangement of a conventional automatic sewing machine control device.

In FIG. 3, those components which have been previously described with reference to FIG. 1 are designated by the same reference numerals or characters. Further in FIG. 3, reference numeral 40 designates an operating panel for setting sewing patterns and sewing speeds; 220, a liquid crystal display unit for displaying an operating procedure, current sewing conditions, error messages, etc. (hereinafter referred to as "an LCD 220", when applicable); 221, a rotary switch for setting sewing speeds (hereinafter referred to as "a speed setting switch", when applicable); 222, a reset switch for resetting a positioning system to a predetermined position; 223, a group of switches including digit keys for setting sewing patterns for instance, the reset switch 222, and the speed setting switch 221; 47, a magnetic data reading and writing device (hereinafter referred to as "an FDD", when applicable) for making access to (writing data in and reading data from) a floppy disk (hereinafter referred to as "an FD", when applicable); and 224, a control device for controlling an automatic sewing machine.

The arrangement of the control device 224 will be described with reference to FIG. 4 In FIG. 4, reference numeral 1 designates a microcomputer including a CPU for arithmetic operations, an external interruption controller, and a direct memory access (hereinafter referred to as "a DMA", when applicable) for making access directly (without the aid of the CPU) to memory; 32, a crystal oscillator for generating a fundamental frequency to operate the microcomputer; 2, a memory address latch circuit (74LS373 for instance) for latching an address in a memory (RAM 61 and ROM 7); 3, a memory data buffer (74LS245 for instance) for transmitting data from memory (ROM 7 and RAM 61) to the microcomputer 1, and data from the microcomputer 1 to the memory (RAM 61 and ROM 7); 4, a peripheral data buffer (74LS24 for instance) for transmitting data from the microcomputer 1 to peripheral elements other than the memory, and from the peripheral elements to the microcomputer 1; 5, an IC select signal generating circuit for producing IC select signals for selecting the memory (ROM 7 and RAM 61) and the peripheral elements (hereinafter referred to as "a decoder 5); 61, a memory element which can be freely accessed for reading and writing data (hereinafter referred to as "a RAM 61", when applicable); 7, a nonvolatile memory element for reading data only (hereinafter referred to as "a ROM 7", when applicable; and 33, a power source backup circuit whose output is maintained generally for several days in order to prevent the difficulty that when, in the case where a RAM is used as a memory element which can be freely accessed for writing and reading data, the power source is turned off, the contents of the RAM are completely erased because it is a volatile memory element.

Figure 4:
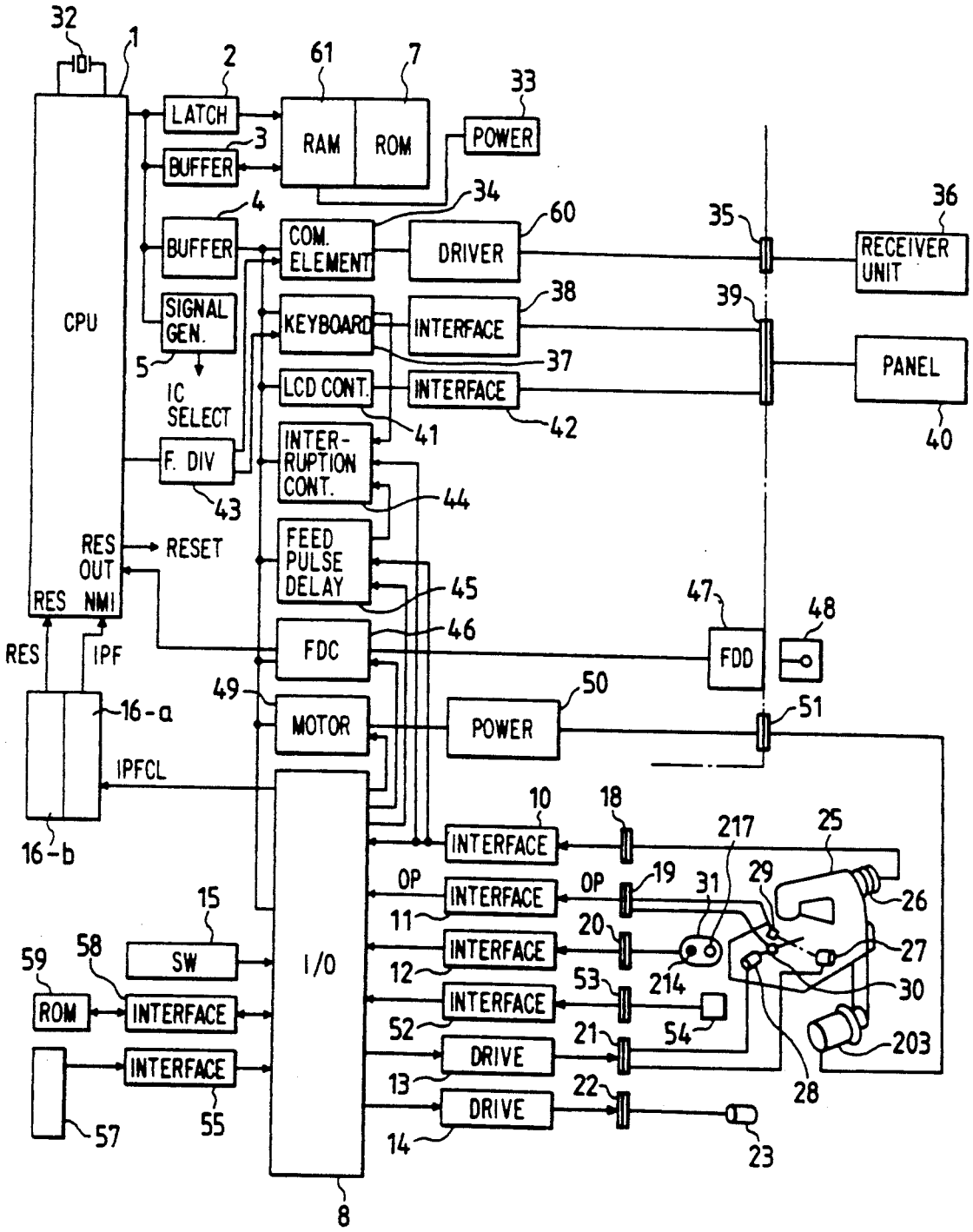
FIG. 4 is an explanatory diagram, partly as a block diagram, showing the arrangement of a control device according to the invention.

Further in FIG. 4, reference numeral 43 designates a frequency division circuit for dividing a constant frequency signal outputted by the microcomputer 1 to provide an output signal which is supplied to a series communication element 34 and a keyboard controller 37; the series communication element 34 being connected to the peripheral data buffer, to convert parallel data into series data and vice versa; 60, a driver for allowing the output data of the series communication element 34 to correspond to a communication standard (RS-232C or RS-422), including an input element and output element (hereinafter referred to as "a series communication driver 60", when applicable); 36, a unit for receiving an input signal when the series communication driver 60 is in an output mode, and providing an output signal when the series communication driver 60 is in an input mode, the unit 36 being an object for series communication (hereinafter referred to as "a series communication object 36", when applicable); 37, the aforementioned keyboard controller for controlling the group of switches 223, the speed switch 221 and the return switch 222 on the operating panel 40; 38, an interface circuit for the keyboard controller; 41, an LCD controller for driving the LCD 220 on the operating panel 40; 42, an interface circuit for the LCD controller and the LCD; 44, an interruption controller for receiving signals from the keyboard controller 37 and a feed pulse delay circuit 45 and receiving a signal from a detector through an input interface circuit 10, to cause the microcomputer 1 to produce an interruption signal; 45, the aforementioned feed pulse delay circuit for determining the timing of production of a feed pulse in response to data provided through the I/O 8 and a signal provided by the detector 10; 46, a floppy disk controller for transmitting signals to a floppy disk driver 47 and receiving signals from the driver 47 (hereinafter referred to as "an FDC", when applicable); and 47, the aforementioned floppy disk driver for writing data in a floppy disk 48 (hereinafter referred to as "an FD", when applicable) according to signals provided by the FDC 46 (hereinafter referred to as "an FDD 47", when applicable).

Further in FIG. 4, reference numeral 8 designates the aforementioned I/O for controlling a variety of parallel input and output signals; 10, 11, 12, 52 and 55, interface circuits for transmitting control signals to the I/O 8; 13, a power circuit for driving the pulse motors in the biaxial drive section (hereinafter referred to as "a PMD 13", when applicable); 49, a circuit for controlling an eddy current coupling type clutch motor (hereinafter referred to as "a motor control circuit 49", when applicable); 50, a power circuit section for receiving a signal from the motor control circuit 49 to operate the eddy current coupling type clutch motor; 15, a switch section for changing a sewing control method (hereinafter referred to as "a sewing control method switch group 15", when applicable); 55, the aforementioned interface circuit for transmitting signals to the I/O 8 from outside the control board; **16-*a*, a momentary power interruption detecting circuit for preventing the control board from erroneous operation when the main power supply is temporarily interrupted; and 16-*b***, an electric source circuit for supplying current to the control board.

Figure 5:
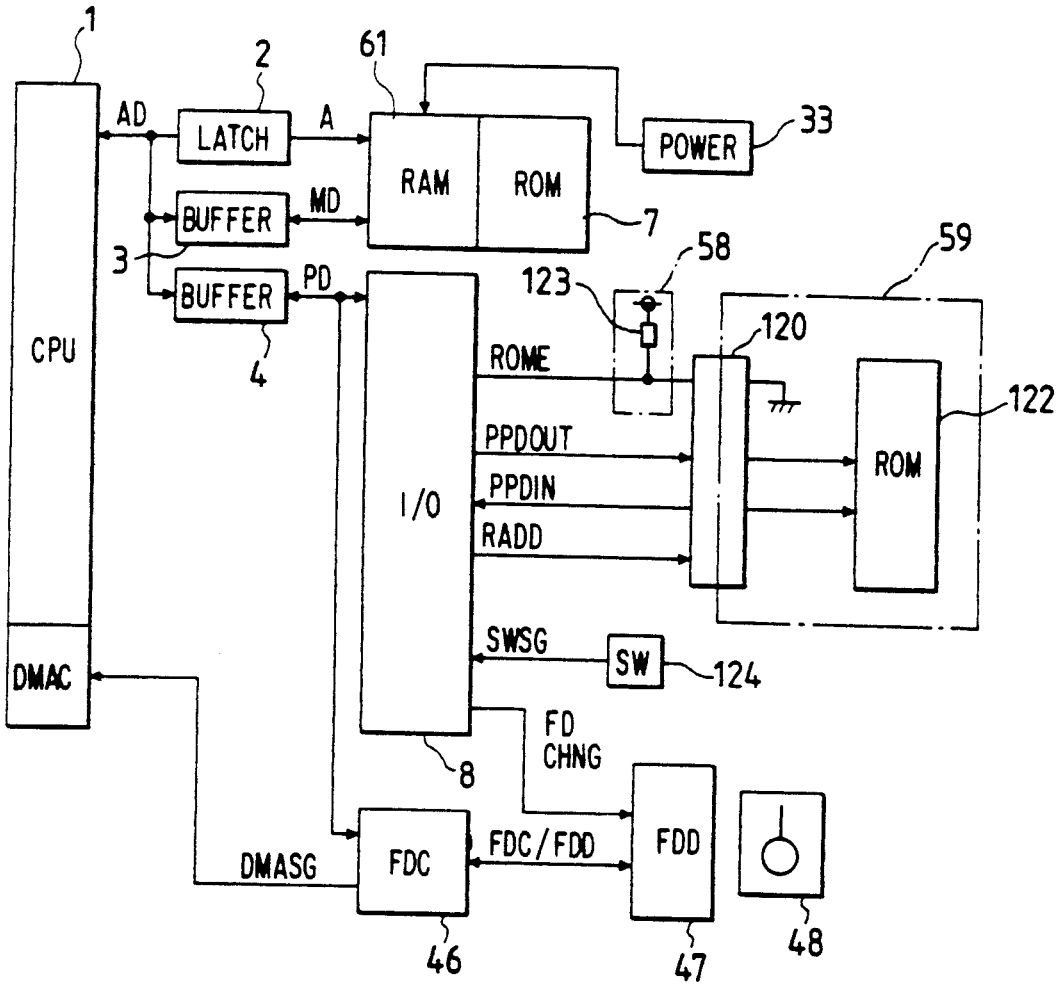
FIG. 5 is a block diagram showing the arrangement of means for writing and reading sewing pattern data in the embodiment of the invention.

FIG. 5 is a block diagram showing a sewing pattern writing and reading circuit. In FIG. 5, those elements which have been previously described with reference to FIG. 4 are therefore designated by the same reference numerals or characters. Further in FIG. 5, reference numeral 120 designates a connector; 122, a nonvolatile memory such as a ROM for storing sewing patterns (hereinafter referred to as "a ROM 122", when applicable); 59, a ROM cassette for accommodating the ROM 122; 58, an I/O and ROM interface circuit serving as an interface between the I/O 8 and the ROM 122 in the ROM cassette 59; 123, a pull-up resistor in the I/O and ROM interface circuit; and 124, one of the switches including in the sewing control method switch group 15, the switch 124 used for switching FDs 48 different in read and write system (hereinafter referred to as "an FD change-over switch 124", when applicable).

Figure 8:
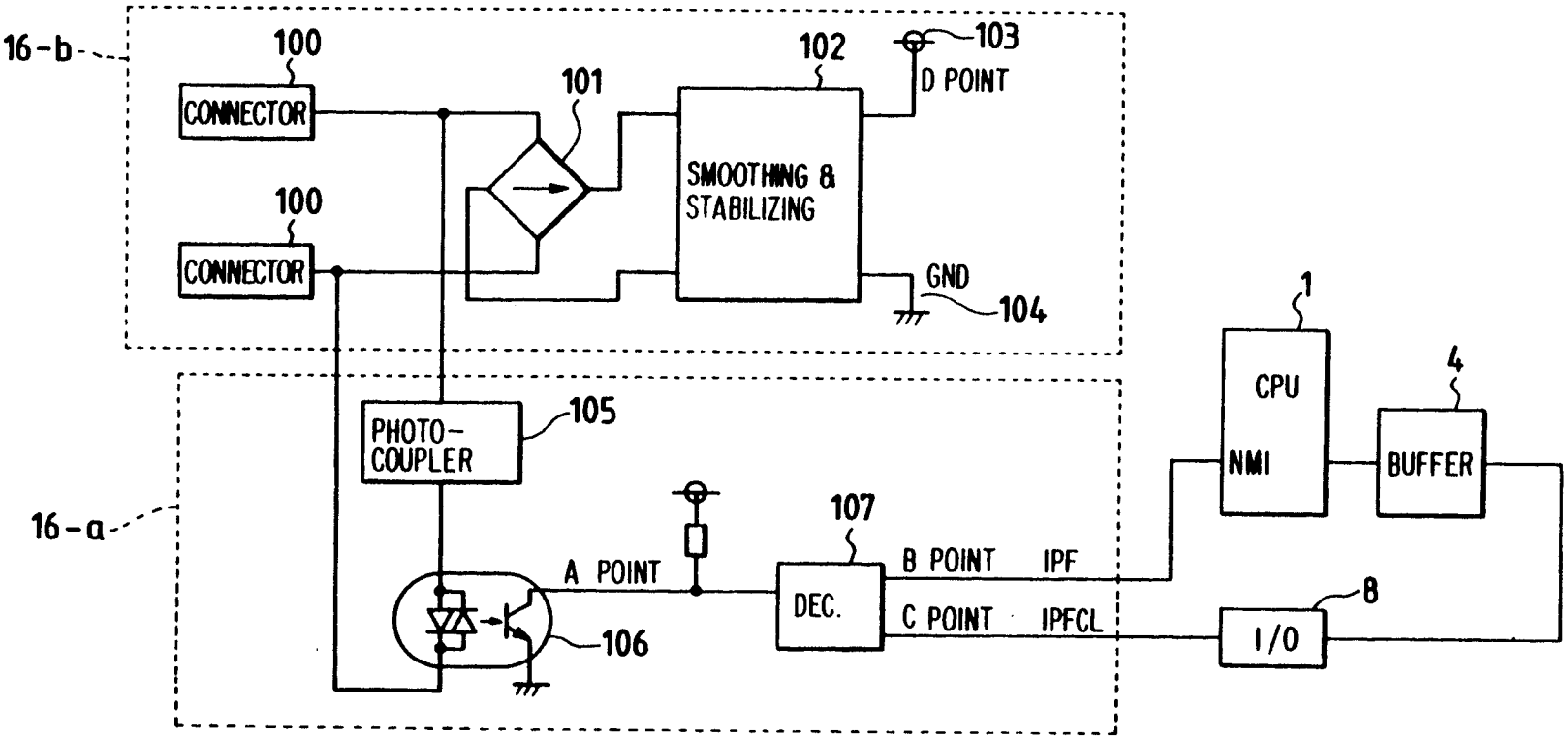
FIG. 8 is a block diagram showing part of an electric source circuit and a momentary power interruption detecting circuit in the embodiment of the invention.

FIG. 8 is a block diagram showing the electric source circuit **16-*b*, and the momentary power interruption detecting circuit 16-*a* in detail. In FIG. 8, those elements which have been previously described with reference to FIG. 4 are therefore designated by the same reference numerals or characters. Further in FIG. 8, reference numeral 100 designates connectors through which AC power is supplied to the electric source circuit 16-*b* when the power switch is turned on; 101, a diode stack for performing full-wave rectification to convert alternating current into direct current; 102, a voltage smoothing and stabilizing circuit for smoothing the waveform of the output of the diode stack 101 to provide a constant voltage; 106*m* a photo-coupler for applying only the peak of the AC waveform to the point A; 105, a resistor for limiting the current flowing in the input diode means of the photo-coupler 105; and 107, a momentary power interruption detecting element for detecting a momentary power interruption with the aid of the output signal of the photo-coupler 105**.

The operation of the automatic sewing machine thus constructed will be described.

First, the power switch 211 of the control device 224 is turned on, to start the eddy current coupling type clutch motor 203 and to supply current to the control device 224 shown in FIG. 4. Thereupon, the electric source circuit 16-*b* applies its output of +5 V for instance to all the elements and circuits. At the same time, in order to prevent the erroneous operations of all the elements and circuits, the electric source circuit applies a reset signal (hereinafter referred to as "a RES signal", when applicable) to the microcomputer 1 to initialize the microcomputer 1 which provides a RES signal at its RESOUT terminal, to initialize all the elements and circuits. The RES signal is eliminated in a predetermined period of time, and the microcomputer 1 reads data from the ROM 7. First, the elements and circuits are initialized. Next, for movement to the mechanical original point with the aid of the output signals of the original point detecting units 29 and 30, the microcomputer 1 applies a signal through the I/O 8 to the PMD 13, so that the pulse motors 27 and 28 are operated to move the biaxial drive unit 208 towards the mechanical original point. When the original point detecting units 29 and 30 provide an original point signal OP (FIG. 4), the microcomputer 1 suspends the application of the signals to the pulse motor 27 and 28, so that the biaxial drive unit 208 is stopped at the mechanical original point.

Now, the operation of the operating panel will be described.

The operating panel is roughly made up of two sections: the first section is the LCD 220, and the second section is the switch group 223. The LCD receives signals received from the LCD controller 41 through the LCD interface circuit 42, to display sewing pattern numbers, sewing speeds, enlarge rate or contract rate, and abnormal points when abnormal conditions occur, and methods of eliminating the abnormal points, methods of operating the sewing machine, and so forth. The group of switches 223 is controlled by a keyboard controller (8279 for instance), and forms a key matrix, monitoring the on-off operations of the switches. For instance when the original point returning switch 22 is operated (depressed), it provides a signal, which is applied through the keyboard controller interface circuit 38 to the keyboard controller 37, so that the latter 37 detects the fact that, of the group of switches 223, the original point returning switch has been turned on, and informs the microcomputer 1 of the fact. Upon reception of a signal representing the operation of the original point returning switch, the microcomputer 1 moves the biaxial drive unit 108 to the original point in the same manner as in the case when the power switch is turned on. Similarly, signals provided by the group of switches 223 are applied to the microcomputer 1, to control the various operations of the sewing machine.

Now, a sewing pattern selecting operation will be described. When a sewing pattern number is determined by operating the switches 223 on the operating panel 40, and a switch for providing a instruction for reading the sewing pattern number thus determined, then the microcomputer 1 reads a ROME signal through the peripheral data buffer 4 and the I/O 8. The ROME signal is set to "0" or "1" depending on the presence or absence of the ROM cassette 59 with the aid of the pull-up resistor 123. More specifically, when the ROM cassette 59 is loaded, the resistor is grounded (connected to the 0V line) in the ROM cassette, and the ROME signal is set to "0". When no ROM cassette is loaded, it is raised to "1" by the resistor 123. The microcomputer 1, detecting the loading of the ROM cassette 59 from the ROME signal, will not drive the FDD 47 through the FDC 46. When, on the other hand, the microcomputer 1 confirms that the ROME signal is at "0" level, the microcomputer 1 makes access to the FDC 46 through the peripheral data buffer 4 and the peripheral data line (hereinafter referred to as "a PD line", when applicable) and provides an instruction to move the head (not shown) of the FD 47 and to turn the FD 48 thereby to determine whether or not the FD 48 is loaded in the FDD 47. That is, in order to read data from the FD 48, it is necessary to drive the drive unit of the FDD 47. As is apparent from the above description, when the ROM cassette is inserted, priority is given to the ROM cassette, and therefore it is unnecessary to drive the FDD every time.

The selection of the ROM cassette 59 or the FD 48 as the sewing pattern memory medium is carried out as described above. This will be described with reference to flow charts of FIGS. 6 and 7(*a*)-7(*b*) in more detail.

Figure 6:
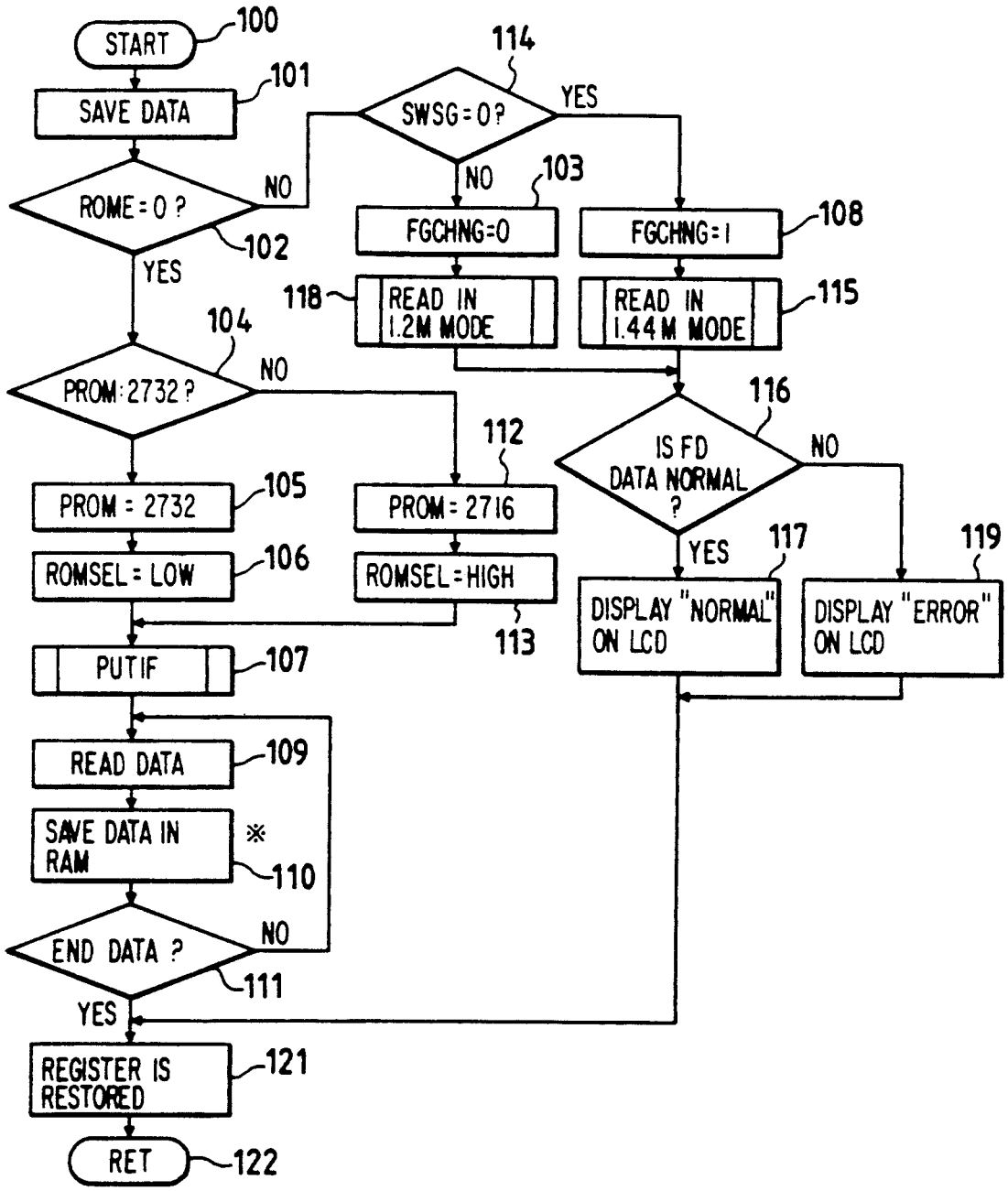
FIGS. 6, **7*a*, and 7*b*** are flow charts for a description of a sewing pattern data reading and writing operation in the embodiment of the invention.

FIG. 6 is a flow chart for reading sewing pattern data into the sewing machine. First, a sewing pattern number is set by operating the switches 223 on the operating panel 40, and the switch for providing a sewing pattern number reading instruction is turned on. This is the state shown in Step 100 in FIG. 6. In Step 101, in order that various registers (not shown) in the microcomputer 1 are used in a data reading operation, the data in the registers are kept saved until the data reading operation is ended. In Step 102, it is determined what is used as the memory medium. With ROME=0, the ROM cassette 59 is employed; and with ROME=1, the FD 48 is selected. In Step 104, it is determined whether the PROM element is "2732" or "2716". In Step 105, it is confirmed again that it is "2732". In Step 106, setting is made for reading "2732". When, in Step 104, it is determined that the PROM element is "2716", then similarly as in the case of "2732" in Step 112 it is confirmed again that it is "2716, and in Step 113 setting is made for reading "2716". In Step 106 or 113, the setting is made on the RAM 61 only. Therefore, in Step 107, a subroutine PUTIF is effected for externally making the setting in practice. In Step 109, data are read.

The flow chart simply indicates that data are read in Step 109, and are saved in the RAM 61 in Step 110; however, the actual data flow is as follows: In FIG. 5, the microcomputer 1 applies the address of the pattern ROM 122 (designated by reference character RADD in FIG. 5, and hereinafter referred to as "an RADD", when applicable) in the ROM cassette 59 to the I/O through the peripheral data buffer and the PD line. The pattern ROM 122 outputs data corresponding to the RADD and applies it to the PPDIN line. The data on the PPDI line is transmitted through the I/O 8 to the PD line, and is temporarily fetched into the microcomputer 1 through the peripheral data buffer 4. The data thus fetched is transferred to the RAM 61 immediately. The above- described operations are repeatedly carried out until END data is read in Step 111, as a result of which the data in the pattern ROM are transferred into the RAM. That is, in Steps 110 and 111 the data are transmitted as was described above.

When in Step 102 ROME=1, Step 114 is effected. In Step 114, the output signal of the FD change-over switch 124 provided for making access to FDs (48) different in read and write system is discriminated. There are available two kinds of 3.5 inch floppy disks; that is, the first is 1.44M bytes in capacity, and the second is 1.2M bytes. This is based on the fact that there are provided two storage systems for the 3.5" floppy disks which are the same in size. In order to make access to the two kinds of floppy disks, the following method is employed: When the output signal of the FD change-over switch 124 is "0", a 1.44M byte mode is employed; and when it is "1", a 1.2M byte mode is employed. In practice, in Step 114, the SWSG signal of the FD change-over switch 124 is discriminated. When SWSG=0, FDCHNG=1 (Step 108) is outputted through the I/O 8, and the data are read with the FDD 47 placed in the 1.44M byte mode (Step 115) When, on the other hand, SWSG=1, FDCHNG=0 (Step 103) is outputted through the I/O 8, and the data are read with the FDD placed in a 1.2M byte mode (Step 118). In Step 116, it is determined whether or not the data thus read are correct. When normal, "Writing has been ended" is displayed on the LCD 220 in Step 117. When abnormal, "Data reading with error" is displayed on the LCD 220 in Step 119.

Both in the cases of the ROM cassette 59 and the FD 48, the saved contents of the registers in the microcomputer are read out, so that the conditions are made the same as those before Step 101 (Step 121). Thereafter, in Step 122, the main software routine is effected again.

The flow of data with the FD 48 is as follows:

When the ROME signal is "1", the FD 48 is selected as the memory medium as was described above. The microcomputer 1 applies a read instruction through the peripheral data buffer 4 and the PD line to the FDC 46. In response to the read instruction, the FDC 46 applies an instruction to the FDD 47 so that the FDD 47 reads data from the FD 48. In general, data are read from the FD 48 at high speed. Therefore, in this case, the method cannot be employed in which, as in the case of reading data from a ROM, data are inputted into the microcomputer 1 through the I/O 8 and then written in the RAM 61. Therefore, the FDC 46 applies a signal DMASG to the microcomputer 1 so that data can be transmitted directly between the FDC 46 and the RAM 61. In response to the signal DMASG, the microcomputer 1 releases the bus lines (the AD line, PD line, MD line and A line), so that data are transferred from the FDC 46 to the RAM 61 at high speed while being controlled by a DMA controller (hereinafter referred to as "a DMAC", when applicable) in the microcomputer 1.

Thus, whether or not the data thus read are normal is determined after the data are all transferred into the RAM 61.

The data read from the ROM cassette 59 or the FD 48 are stored in the volatile RAM 61. The RAM 61 is supported by the backup circuit 33 in such a manner that, even when the power supply is turned off, the backup circuit 33 supplies voltage to the RAM 61. Hence, the data are kept stored for a relatively long time, until the backup circuit ceases its operation.

Figure 7B:
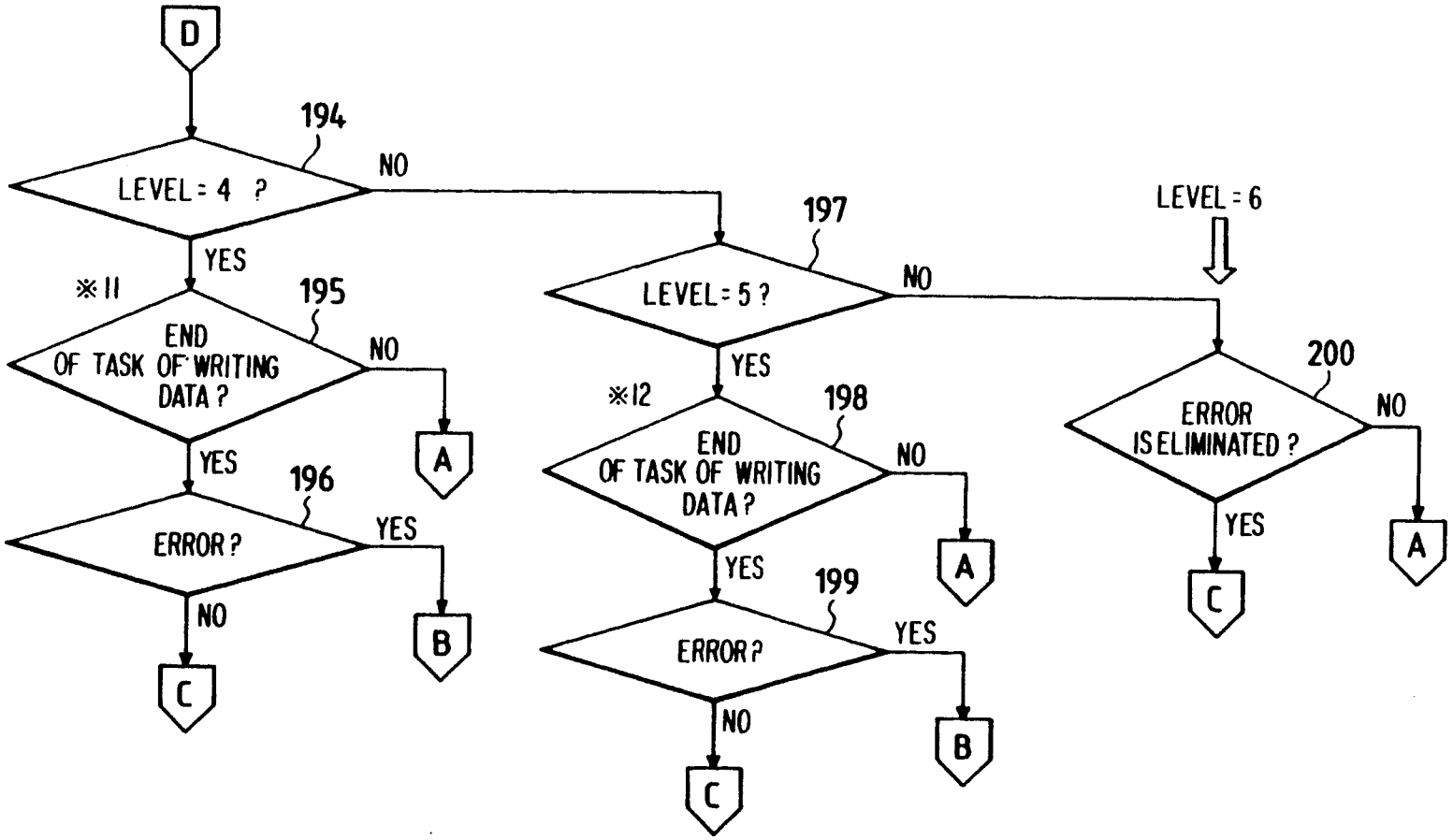

Now, a sewing pattern data writing operation will be described with reference to a flow chart of FIG. 7.

When a data writing operation is set with the switches 223 on the operating panel 40, a data writing routine is effected in Step 150. In Step 151, similarly as in the data reading operation, in order that the various registers in the microcomputer 1 are used in a data writing operation, the data in the registers are kept saved until the data writing operation is ended. In Steps 152, 168, 174, 80, 188, 194, 197 and 200, levels are determined according to processing conditions, writing media, or decision as to whether or not data are written correctly. Step 151 reveals the routine which is encountered once when the data writing routine is effected. That is, in Step 151, discrimination of a writing medium and confirmation of an empty area in the writing medium are carried out. Steps 153 and 154 are to indicate that the control device is in write condition. That is, in Step 153, a RUN LED is turned off, which is kept turned on when a sewing operation is allowed; and in Step 154, a write LED is turned on, to indicate that the control device is in a write mode. In Step 155, the display on the LCD is changed from a sewing condition to a writing condition. In Step 156, it is determined according to the ROME signal whether the memory medium is the ROM cassette 59 or it is the FD 48. When ROME=0, Step 157 is effected. In Step 157, since there is a ROM which cannot be used for a data writing operation with the control device, it is determined whether or not the ROM can be used for a data writing operation. When the ROM cannot be used for a data writing operation, in Step 159 an error LED is turned on, and in Step 160 an error message is displayed on the LCD 220. Next, in step 161, the next level "6" is specified, and in Step 158 the registers of the microcomputer 1 are restored, so that the operation leaves the routine. Thereafter, other processing operations are carried out, so that Step 150 is effected again. In Step 151, the contents of the registers are saved, and the level is determined to "6". The level "6" is to indicate an error as was described before. The error condition is maintained until the error eliminating key in the group of switches 223 is operated. Discrimination of this condition is carried out in Step 200. Before the error eliminating key is depressed, the operation is advanced to "A", and in Step 158 the registers are restored, so that the processing operation leaves the data writing routine. That is, the error condition is maintained. When, with the level "6", the operator turns on the error eliminating key, the processing operation is advanced to "C". In Step 189 the write condition indicating LED is turned on, in Step 190 the sewing condition indicating LED is turned off, the level is set to "0" again, in Step 193 the LCD 220 is placed in the condition provided in a sewing operation, in Step 158 the registers are restored, and the main software routine is effected again.

When, on the other hand, it is determined in Step 157 that the ROM can be used for a data writing operation, Step 163 is effected. In step 163, the level is set to "1", and in Step 164 a task of confirming an empty area in the ROM is performed. Thereafter, in Step 158 the registers are restored, and the main program is effected. Again in Steps 150 and 151, the operations are performed. In Step 168, level=1 is determined, so that the operations for the level "1" are carried out. With the level "1", it is determined whether or not the ROM empty area has been confirmed (Step 169), and the remaining operations are not carried out until the task of confirming a ROM empty area is accomplished. Upon completion of the task, Step 170 is effected. If no empty area is available, the processing operation is shifted to "B". Thus, in step 159, the above-described error processing operation is carried out.

When in Step 170 an empty area is available, Step 171 is effected. In Step 171, a needle number and a write number are set. In Step 172, the needle number and the write number are displayed on the LCD 220.

Thereafter, in Step 173 the level is set to "3", and the processing operation leaves the routine. When, under this condition, the operation is returned to the write routine (Step 150) again, the operations in Steps 151, 152, 168 and 174 are performed, and in Step 180 the level is determined "3", so that the processing operations for the level "3" are carried out. In step 181, it is determined whether or not the write start key in the group of keys 223 is depressed. If the write start key is not depressed, Step 188 is effected. Step 188 concerns the decision of the same key that is used for effecting the write routine, and it is used for eliminating the write condition in the write routine. More specifically, when in Step 188 it is determined that the write key is not turned on, Step 158 is effected, so that the operation is returned to the main routine, and Step 150 is effected again. If in Step 188 it is determined that the write key is turned on, the same operations as those in "C" with the level 6 are carried out; that is, the write LED is turned off, the RUN LED indicating that a sewing operation can be performed is turned on, the level is returned to "0", the LCD 220 is set for a sewing operation, and the main routine is effected again. Step 150 is not be effected until the write switch is turned on again.

When in Step 181 it is determined that the write start switch is turned on, the write LED is flickered, thus indicating that a writing operation is being carried out (Step 182). In Step 183, it is determined whether the writing memory medium is the ROM cassette or it is the FD 48. When it is determined that the writing memory medium is the ROM cassette, then in Step 184 the level "4" is specified, and a task of writing data in the ROM cassette is performed. When, on the other hand, it is determined that the memory medium is the FD, in Step 186 the level "5" is specified, and a task of writing data in the FD is started. In the case of writing data in the ROM cassette 59, Step 158 is effected, the operation is returned to the main program, and Steps 150 and 151 are effected. Thereafter, the operations in Steps 152, 168, 174 and 180 are performed, and then in Step 194 the level "4" is determined, and Step 195 is effected. In Step 195 it is determined whether or not the task of writing data in the ROM cassette has been ended. If the task is not ended, the registers are restored (Step 158), the operation leaves the write routine, and the operations in Steps 150 through 159 are performed in the same order. These operations are carried out until the task of writing data in the ROM cassette is ended. After the task has been ended, Step 195 is effected, and then Step 196 is effected. In Step 195 it is determined whether or not an error occurs with the data writing operation. If it is determined that an error has occurred, Step 159 is effected, so that the same operations are performed as those described before. When it is determined that no error has occurred, "C" is effected; that is, Step 189 is effected, so that the above-described operation for normal ending is performed. Thus, the data writing operation has been accomplished. When in Step 187 it is determined that the task of writing data in the FD has been started, Step 158 is effected, so that the registers are restored, and the operation leaves the write routine. Then, Step 150 is effected again. In Step 151, the contents of the registers are saved, and the operations in Steps 152, 158, 174, 189 and 194 are performed. Then, in step 197, the level "5" is determined, and Step 198 is effected. In Step 198, it is determined whether or not the task of writing data in the FD has been ended. If the task has not been ended, the registers are restored (Step 158), and the operation leaves the write routine, and similarly as in the above-described case the operations in Steps 150 through 198 are carried out. These operations are performed until the task of writing data in the FD is ended. After the task, Steps 198 and 199 are effected. In Step 199, it is determined whether or not an error has occurred with the data writing operation. If it is determined that an error has occurred, the above-described Step 159 is effected, and the same operations are carried. If, on the other hand, it is determined that no error has occurred with the data writing operation, Step 189 is effected, so that the above-described operation for normal ending is performed. Thus, the data writing operation has been ended.

The arrangement and operation of the momentary power interruption detecting circuit 16-*a* will be described. The momentary power interruption detecting circuit 16-*a* and the electric source circuit 16-*b* are roughly as shown in FIG. 8. When the power switch 211 is turned on, the alternating current is applied through the connectors 100 to the diode stack 101, where it is subjected to full-wave rectification. The output of the diode stack 101 is smoothed into direct current by the DC stabilizing circuit 102. The direct current is supplied as an element electric source 103 for the elements on the control board (hereinafter referred to as "a control board element electric source", when applicable). The DC stabilizing circuit 102 includes a capacitor so that when the power switch 211 is turned off, the electric source 103 is maintained for a short period of time as it is. The alternating current supplied through the connectors 100 is applied through a current limiting resistor 105 to the input of the photo-coupler 106. The current limiting resistor 105 allows the photo-coupler 106 to provide an output only when the alternating current is around its peak. According to the output of the photo-coupler 106, the momentary power interruption detecting element 107 detects the occurrence of momentary power interruption, to enable the interruption terminal of the microcomputer.

Figure 9:
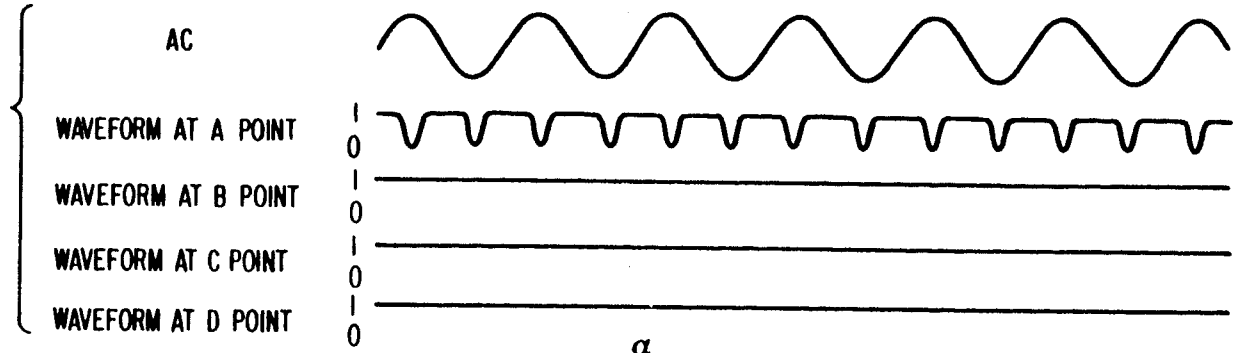
FIGS. 9, 10 and 11 are time charts for a description of the operation of the momentary power interruption detecting circuit.
Figure 10:
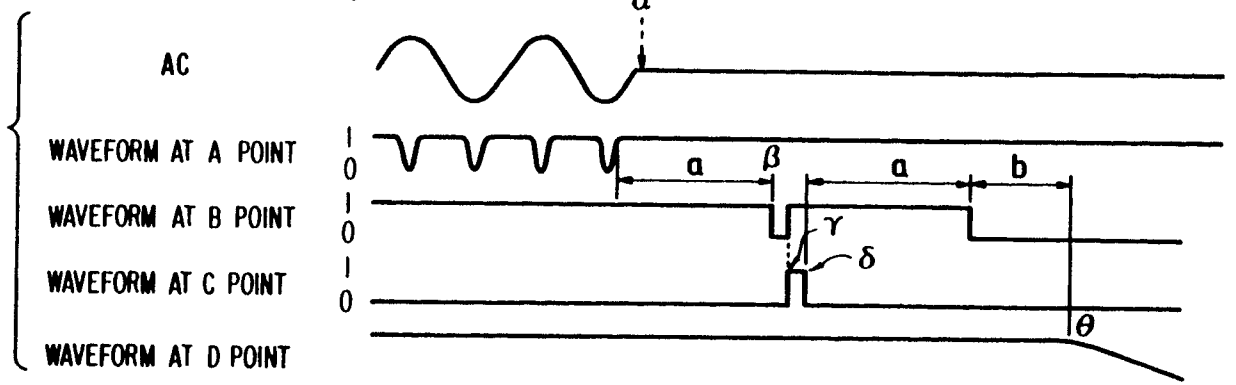
Figure 11:
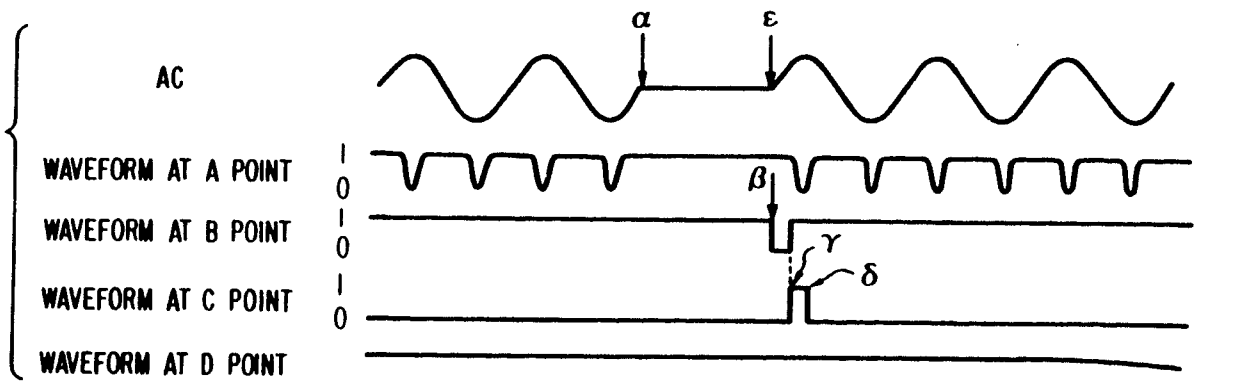

The alternating current waveform shown in FIGS. 9, 10 and 11 is that which is applied through the above-described connectors 100. The A point waveform is of the output of the photo-coupler; the B point waveform is of the output of the momentary power interruption detecting element 107 (hereinafter referred to as "an IPF", when applicable); the C point waveform is of a momentary power interruption detecting element clear signal (hereinafter referred to as "an IPFCL", when applicable) applied to the momentary power interruption detecting element through the I/O 8; and the D point waveform indicates the condition of the control board element electric source 103. FIG. 9 shows the normal waveforms provided when the power switch 211 is turned on.

FIG. 10 shows the waveforms provided when the power switch 211 is turned on with the timing of $\alpha$.

Figure 12:
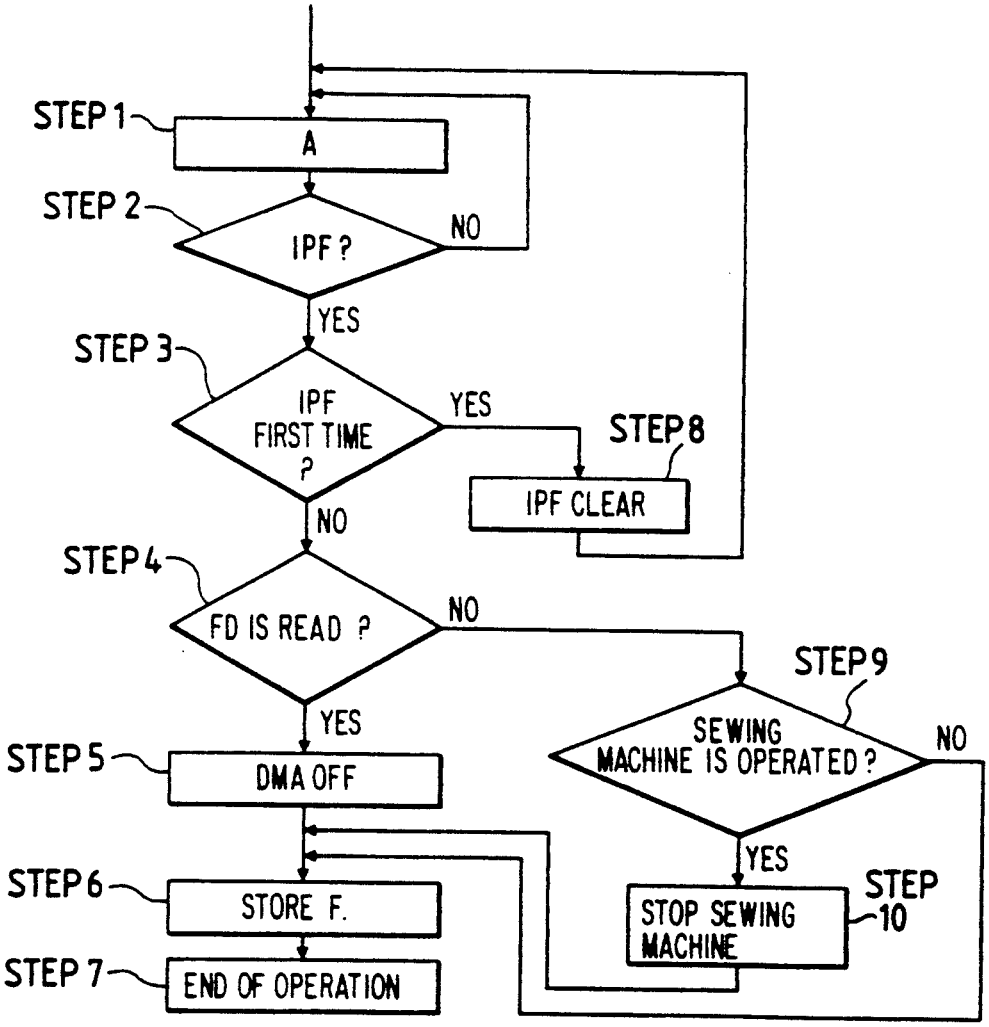
FIG. 12 is a flow chart for a description of a momentary power interruption detecting operation in the invention.

FIG. 12 is a flow chart in the case where the IPF signal is applied in a routine A (Step 1) of performing an ordinary sewing operation. When the power switch 211 is turned off, the A point waveform is raised to "1" instead of "0". A certain period of time after the A point waveform is raised to "1" in the above- described manner, the B point waveform is set to "0" from "1", thus indicating the fact that momentary power interruption occurs with the interruption terminal of the microcomputer 1. Upon reception of the first IPF signal (Step 2), the microcomputer 1 applies an instruction signal through the peripheral data buffer 4 to the I/O 8 to cause the I/O 8 to produce the IPFCL signal, so that the I/O 8 produces the IPFCL signal "1" with the timing of $\Gamma$ (Steps 3 and 8). If the IPFCL signal is held at "1" as it is, then the momentary power interruption detecting element cannot operate in its initial state. Therefore, the microcomputer 1 applies an instruction signal through the peripheral data buffer 4 to the I/O 8 to set the IPFCL signal to "0". As a result, the IPFCL signal is set to "0" with the timing of δ. A period of time (a) after the IPFCL signal is set to "0", the IPF signal is set to "0" again, and the microcomputer 1 receives the second IPF signal (Step 2). In response to the second IPF signal, the microcomputer 1, considering that the main power source is turned off or electric power interruption lasts for a long time, determines whether or not the FD is being read in Step 4. When it is determined that the FD is being read, Step 5 is effected, so that the microcomputer 1 causes the FDC 46 to provide an instruction signal to stop the FDD 47. In Step 6, the microcomputer suspends making access to the RAM 61, thus being placed in standby state. In the case where access is not made to the FD for reading or writing, Step 9 is effected. If, in this case, the sewing machine is in operation, then it is stopped (Step 10), and Step 6 is effected. This operation is carried out by the time instant (θ) the output signal 103 of the DC stabilizing circuit 103; i.e., the D point waveform decreases, or within a period of time (b). The waveforms provided when the momentary power interruption is eliminated in a short time are as shown in FIG. 11. Phenomena α, β, Γ and δ in FIG. 11 occur in the same manner as those in FIG. 10. In the case where the power source is restored at the time instant E, the A point waveform is also restored as shown in FIG. 11, and therefore the second IPF signal is not produced. Hence, the microcomputer 1 operates normally.

As is apparent from the above description, the erroneous operations which may take place with the FD when momentary power interruption occurs are prevented by employment of means for detecting momentary power interruption to provide a momentary power interruption detection release signal at the beginning of the momentary power interruption. In addition, with the service life of the FD taken into account, the circuit is provided to determine whether or not the ROM is loaded; and in the case where the FD is also loaded, data are read or written with precedence given to the ROM, whereby the service life of the FD is increased as much. In the case where FDs different in their read and write systems are used, means for selecting a suitable one of the read and write systems is provided so as to make access to those FDs different in their read and write system.

Employment of FDs increases sewing data several hundred times, thus allowing the storage of a large number of sewing patterns. The erroneous operations attributing to the employment of FDs are prevented by using the momentary power interruption detecting means. That is, although the FDs are used, the operation is the same as in the prior art using the ROM. In the case where the ROM is loaded, a data reading and writing operation is carried out with precedence given to the ROM over the FD; that is, in this case, it is unnecessary to operate the FD, and the service life of the latter is increased as much. Furthermore, the invention provides the means for making access to FDs different in their write system, with the result that the FD read and write systems are switched. In the case where both the FD and the ROM are employed, the presence or absence of the ROM is detected, and a data reading and writing operation is carried out with precedence given to the ROM over the FD. As a result, the service life of the FDD is also increased. The provision of the momentary power interruption detecting means prevents the erroneous operation of the FDD when the power source is turned off, and protects the backup memory. The detection of momentary power interruption is achieved substantially being free from noise.

In general, it is necessary for a floppy disk drive (FDD) to rotate the floppy disk to make access to the floppy disk. Therefore, the period of time for which the floppy disk can be used with the floppy disk drive is the service life of the floppy disk (FD).

In the above-described embodiment, two kinds of memory means, a ROM and a FD different in operation are employed. However, it goes without saying that the memory means may include IC cards.

In the case where an IC card or IC cards are employed instead of the ROM and are made interchangeable with the FD, then memory capacity is further increased. Furthermore, employment of the three memory means, the ROM, IC cards and FD, in combination will provide sewing pattern interchangeability with ease.

In the case where the FD and the IC cards are used in combination, the IC card may be connected to the output (A) of the address latch circuit 2 and the output (MD) of the memory data buffer 3 with the I/O 8, the I/O to ROM interface circuit 58, and the ROM cassette 59 eliminated, or it may be connected directly to the I/O 8.

Now a parallel communication process of applying an outside signal to the control board will be described with reference to FIG. 13. When an external control switch (not shown) in the sewing control method switch group 15 is turned off, the automatic sewing machine is controlled with the ordinary settings on the operating panel. When, on the other hand, the external control switch is turned on, part of the functions of the operating panel, and the operation of the foot switch 217 come under external control; that is, they are controlled by signals applied through the external signal interface circuit 55 and the I/O 8.

Figures 13, 14:
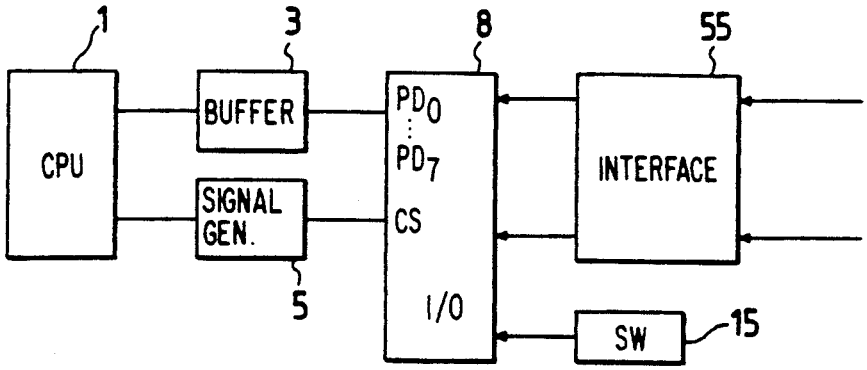
FIG. 13 is a block diagram showing a parallel communication circuit in the invention.
FIG. 14 is a diagram showing examples of signals in the parallel communication circuit.

The signals for external control are for instance as shown in FIG. 14. The operation will be described which is performed when external signals are inputted. First, a sewing speed and a sewing pattern number are externally set. A sewing speed is set with a 4-bit signal; that is, sewing speeds from 0 to 16 can be digitally set. In a sewing pattern number, OPTN1 through OPTN8 represent the unit digits, and OPTB10 through OPTB80 the tenth digits. After the sewing speed and the sewing pattern number have been set, a retaining signal (hereinafter referred to as "an OS10", when applicable) or a two-step retaining signal (hereinafter referred to as "an OS11", when applicable) is externally applied. Upon application of the OS10, in the automatic sewing machine the outside retaining board 204 is moved downwardly; and in response to the OS11, a two-step retaining board (not shown) is moved downwardly. At the same time, a sewing pattern corresponding to the sewing pattern number is inputted, so that the automatic sewing machine becomes ready to start. Furthermore, the sewing speed is read, so that the sewing operation can be started with the sewing speed specified externally.

When a start signal (hereinafter referred to as "an OS 12", when applicable) is inputted, the automatic sewing machine starts a sewing operation according to the sewing pattern corresponding to the sewing pattern number thus externally specified at the sewing speed thus externally specified.

In the above-described embodiment, the momentary power interruption detecting circuit receives the IPFCL signal from the I/O 8; however, the signal may be produced by using the output of the IC select signal generating circuit 5. All that is required for the IPFCL signal is to clear the momentary power off detecting element, and therefore the signal may be obtained by combination of the address lines.

Input signals from an external personal computer and sequencer may be used through communication automatically to determine a sewing pattern and a sewing speed, to drive the cloth retaining means, and to start the sewing machine.

The above-described parallel communication process makes it unnecessary to use almost all the functions of the operating panel 40. Application of pattern data with the retaining signal (or two-step retaining signal) makes it unnecessary to use control lines for an acknowledge signal etc., thus reducing the number of ports.

As is apparent from the above description, communication means may be provided in combination with a personal computer, sequencer, etc. so that it transmits and receives sewing pattern data, and instruction signals necessary for the operation of the sewing machine such as signals for determining a sewing pattern and a sewing speed, signals for driving the cloth retainer, and a signal for returning the needle to the original point. This method provides the following merit: Heretofore, it is necessary to provide one operator for each sewing machine; however, according to the method, a plurality of sewing machines may be controlled by a host computer; that is, only one operator is required for a number of sewing machines.

In the above-described embodiment, switching of the FD 48 according to the memory capacity is carried out with the sewing control method switch group 15. However, the manual selection with the switch group 15 may be eliminated by employing the following method: The FD 48 is read in a 1.2 M byte mode to determine whether or not the data is normal. When it is determined that the data is normal, the reading of the FD in the 1.2M byte mode is continued. When it is determined that the data is abnormal, the reading of the FD is carried out in a 1.44M byte mode. When it is impossible to read the FD in the 1.44M byte mode, the reading operation is ended with the indication of error. When it is possible to read the FD correctly in the 1.44M byte mode, the reading of the FD in the 1.44M byte mode is automatically allowed. It goes without saying that the above- described method may be so modified that the FD is read first in the 1.44M byte mode and then in the 1.2M byte mode.

Effects of the Invention

As was described above, according to the invention, a plurality of memory means different in kind are employed for recording sewing patterns, and of these memory means, a particular one is automatically selected, and the means for supplying electric power for the initial period of time upon occurrence of an electric power interruption is provided, and the sewing operation may be externally controlled. Thus, in the automatic sewing machine control method, and the device for practicing the method according to the invention can provide an automatic sewing machine which is high in the interchangeability of software and high in reliability, and which can be operated on an automation line with ease and can be operated readily.

What is claimed is:

1. An automatic sewing machine, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of units which are adapted to store sewing patterns; and selecting means for selecting one of said plurality of memory units in said second memory means and automatically giving priority to the operation of a predetermined type of memory medium.

2. An automatic sewing machine as claimed in claim 1, wherein said plurality of memory units in said second memory means include detachable memory media which are detachably loaded in said second memory.

3. An automatic sewing machine as claimed in claim 1, wherein said plurality of different types of memory units are each different in their data reading and writing operations.

4. An automatic sewing machine as claimed in claim 2, wherein said plurality of different types of memory units are each different in data reading and writing operations.

5. An automatic sewing machine as claimed in claim 1, wherein said control means further comprises a temporary memory means and a backup electric source, and wherein plurality of types of memory units, which are different from one another in transmission of data to and in reception of data from said temporary memory means with said backup electric source, are included in said control means.

6. An automatic sewing machine as claimed in claim 2, wherein said control means further comprises a temporary memory means and a backup electric source, and wherein said plurality of types of memory units, which are each different from one another in transmission of data to and in reception of data from said temporary memory means with said backup electric source, are included in said control means.

7. An automatic sewing machine, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of units which are adapted to store sewing patterns; and selecting means for selecting one of said plurality of memory units in said second memory means, wherein said second memory means comprises at least a magnetic recording unit, and an electrically non-volatile memory unit.

8. An automatic sewing machine, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of memory units which are adapted to store sewing patterns; and selecting means for selecting one of said plurality of memory units in said second memory means, wherein said plurality of memory units in said second memory means include detachable memory media which are detachably loaded in said second memory, and wherein said second memory means comprises at least a magnetic recording unit, and an electrically non-volatile memory unit.

9. An automatic sewing machine as claimed in claim 8, wherein said selecting means gives precedence to a memory unit whose memory medium operates electrically only over a memory unit whose memory medium operates mechanically.

10. An automatic sewing machine, comprising:

sewing means for forming means on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of memory units which are adapted to store sewing patterns; and selecting means for selecting one of said plurality of memory units in said second memory means automatically giving priority to the operation of a memory medium in a predetermined type of memory unit, and giving precedence to a memory unit whose memory medium operates electrically only over a memory unit whose memory medium operates mechanically.

11. An automatic sewing machine as claimed in claim 8, wherein said selecting means selects an electrically nonvolatile memory unit with priority.

12. An automatic sewing machine, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of units which are adapted to store sewing patterns; and selecting means for selecting one of said plurality of memory units in said second memory means, automatically giving priority to the operation of a memory medium in a predetermined type of memory unit, and selecting an electrically nonvolatile memory unit with priority.

13. An automatic sewing machine as claimed in claim 9, wherein said selecting means selects an electrically nonvolatile memory unit with priority.

14. An automatic sewing machine as claimed in claim 10, wherein said selecting means selects an electrically nonvolatile memory unit with priority.

15. An automatic sewing machine as claimed in claim 8, wherein upon detection that said memory medium of said memory unit selected by said selecting means with priority is not available, a subsequent memory unit is automatically selected by said selecting means.

16. An automatic sewing machine, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing control programs for said microcomputer;

second memory means including a plurality of different types of units which are adapted to store sewing patterns; and selecting means for selecting one of said plurality of memory units in said second memory means, automatically giving priority to the operation of a memory medium in a predetermined type of memory unit, and automatically selecting a subsequent memory unit upon detection that said memory medium of said memory unit selected by said selecting mans with priority is not available.

17. An automatic sewing machine as claimed in claim 9, wherein upon detection that said memory medium of said memory unit selected by said selecting means with priority is not available, a subsequent memory unit is automatically selected by said selecting means.

18. An automatic sewing machine as claimed in claim 10, wherein upon detection that said memory medium of said memory unit selected by said selecting means with priority is not available, a subsequent memory unit is automatically selected by said selecting means.

19. An automatic sewing machine as claimed in claim 2, wherein said second memory means has a plurality of memory units of at least one type, said sewing machine further comprising second selecting means for selecting one of said plurality of memory units in response to a predetermined instruction.

20. An automatic sewing machine as claimed in claim 9, further comprising an electric source, wherein said predetermined type of memory unit to which priority is given during selection is automatically selected upon application of electric power from said electric source.

21. An automatic sewing machine as claimed in claim 9, further comprising an electric source, wherein said predetermined type of memory unit to which priority is given during selection is automatically selected upon application of electric power from said electric source.

22. An automatic sewing machine, comprising:

sewing means for forming seams on a sewing material;

cloth retaining means for holding said sewing material;

drive means for moving said cloth retaining means for controlling the operations of said sewing means, cloth retaining means, and drive means, said control means comprising:

a microcomputer operating as a central control unit;

non-volatile memory means for storing programs for said microcomputer;

a magnetic memory unit for storing sewing patterns;

an electrical non-volatile memory unit for storing sewing patterns; and means for giving precedence to operation of said electrical non-volatile memory means over that of said magnetic memory means when memory media are loaded in said electrical non-volatile memory means and said magnetic memory means.

23. An automatic sewing machine adapted for use with an electric source, comprising:

sewing means for forming seams of a sewing material;

cloth retaining means for holding said sewing material;

drive means for moving said cloth retaining unit; and control means for controlling the operations of said sewing means, said cloth retaining means, and said drive means, said control means comprising:

a microcomputer operating as a central control unit;

electric source stabilizing means for supplying electric power to electrically operating parts of said sewing means upon suspension of a supply of electric power from said electric source; and momentary power interruption compensating means for detecting said suspension of the supply of electric power from said electric source as an electric power interruption, and for delaying transmission of a power interruption detection signal for stopping said sewing machine at a beginning of said electric power interruption to cause said electric source stabilizing means to continue the supply of electric power.

24. An automatic sewing machine as claimed in claim 23, wherein said momentary power interruption compensating means comprises means for producing a momentary power interruption detection eliminating signal to eliminate said power interruption detection signal.

25. An automatic sewing machine as claimed in claim 23, wherein said momentary power interruption compensating means comprises power interruption continuation discriminating means for determining continuation of electric power interruption.

26. An automatic sewing machine as claimed in claim 24, wherein said momentary power interruption compensating means comprises power interruption continuation discriminating means for determining the continuation of electric power interruption.

27. An automatic sewing machine adapted for use with an electric source, comprising:

sewing mechanism means for forming seams on a sewing material;

cloth retaining means for holding said sewing material;

drive means for moving said cloth retaining means; and control means for controlling the operations of said sewing mechanism means, said cloth retaining means, and said drive means, said control means comprising:

a microcomputer operating as a central control unit;

memory means controlled by said microcomputer, for storing sewing patterns for use in sewing operations;

electric source stabilizing means for supplying electric power as required upon detection of the interruption of said electric source; and power interruption counteracting means for instructing and terminating said memory means in operation, upon detection of the interruption of said electric source.

28. An automatic sewing machine as claimed in claim 27, wherein said power interruption counteracting means instructs said memory means upon detection of continuation of the interruption of said electric source.

29. An automatic sewing machine, comprising:

sewing mechanism means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

non-volatile memory means for storing programs or the like necessary for control;

a magnetic memory unit for storing sewing patterns;

an electrical non-volatile memory unit for storing sewing patterns; and means for detecting a momentary power interruption, and for generating a momentary power interruption detection eliminating signal at a beginning of said momentary power interruption.

30. An automatic sewing machine for use with an electric source, comprising:

sewing means for forming seams on a sewing material;

cloth retaining means for holding said sewing material;

drive means for moving said cloth retaining means; and control means for controlling the operations of said sewing means, said cloth retaining means, and said drive means, said control means comprising:

a microcomputer operating as a central control unit;

first memory means for storing programs for controlling said microcomputer;

second memory means for storing sewing patterns;

communication means for externally applying instructions for controlling operations of said sewing machine;

means for detecting an interruption of power of said electric source and for counteracting the power interruption, whereby an operation of said automatic sewing machine is maintained; and means for setting externally a sewing speed of said sewing machine, wherein said sewing machine becomes ready to start a sewing operation when a predetermined sewing pattern is inputted in response to an operating instruction which is applied through said communication means to said cloth retaining means, and said sewing operation is commenced with said externally set sewing speed.

31. An automatic sewing machine as claimed in claim 30, further comprising:

an operating section for setting sewing operation control instructions for said microcomputer to operate said sewing machine directly; and sewing operation control instruction selecting means for determining whether control instructions from said operating section are selected or control instructions from said communication means are selected.

32. An automatic sewing machine adapted for use with external equipment, comprising:

sewing means for forming seams on a sewing material;

cloth retaining means for holding said sewing material;

drive means for moving said cloth retaining means; and control means for controlling operations of said sewing means, said cloth retaining means, and said drive means, said control means comprising:

a microcomputer operating as a central control unit;

non-volatile memory means for storing programs for controlling said microcomputer;

a magnetic memory unit for storing sewing patterns;

an electrical memory unit for storing sewing patterns;

an operating section for providing instructions for controlling said sewing machine;

communication means for communicating with said external equipment to externally control said sewing machine; and selecting means for determining whether said sewing machine is operated by said operating section or is operated through said communication means and automatically giving priority to an operation of a predetermined type of memory unit.

33. A method of controlling an automatic sewing machine, comprising:

providing a plurality of types of memory units;

inputting a sewing pattern read or write instruction to said automatic sewing machine;

confirming, in response to said sewing pattern read or write instruction, the presence of a memory medium in a predetermined kind of memory unit which is included in said plurality of types of memory units provided for said automatic sewing machine;

operating either said memory medium, the presence of which has been confirmed, or operating, only when the presence of said memory medium is not confirmed, a memory medium in a second of said plurality of types of memory units;

according to the type of said memory unit, reading the data of said memory medium, the presence of which has been confirmed, and storing the data in a temporary data storage memory medium, or writing data therein after detecting that said memory medium, the presence of which has been confirmed, is enabled;

accessing said data stored in said temporary data storage memory medium or the written data; and performing a sewing operation by said automatic sewing machine utilizing said data stored in said temporary data storage medium or the written data.

34. A method of controlling an automatic sewing machine, comprising:

monitoring the supply of electric power from an external electric source;

providing a power interruption detection signal upon detection of an interruption of said external electric source;

storing said power interruption detection signal, and subsequently eliminating said power interruption detection signal, and causing a power stabilizing electric source provided inside said automatic sewing machine to supply electric power; and subsequently monitoring the supply of electric power from said external electric source, said subsequent electric power supply monitoring step taking into consideration a delay time of said supply of electric power from said external electric source; and transmitting a power interruption detection signal upon detection of an interruption of said external electric source, to stop said automatic sewing machine.

35. A method of controlling an automatic sewing machine adapted for use with a cloth retainer and a sewing needle, comprising:

providing means for communicating with the automatic sewing machine, said communicating means being external to said automatic sewing machine;

setting data including at least sewing patterns and sewing speeds, said communicating means being coupled to means for automatically setting sewing patterns and sewing speeds;

inputting signals through said communicating means, to externally instruct a predetermined sewing operation including a pattern sewing operation and a preparatory operation for said pattern sewing operation, said signals including at least a retainer signal for moving said cloth retainer, and a signal for returning said sewing needle to an origin position; and inputting a signal for execution of said predetermined sewing operation through said communicating means, and performing the predetermined sewing operation of said automatic sewing machine.

* * * * *